US007100490B2

(12) United States Patent
Muller, Jr.

(10) Patent No.: US 7,100,490 B2
(45) Date of Patent: Sep. 5, 2006

(54) BODY ARMOR

(76) Inventor: Robert L. Muller, Jr., 141 Joffre Ave., Stamford, CT (US) 06905

( * ) Notice: Subject to any disclaimer, the term of this patent is extended or adjusted under 35 U.S.C. 154(b) by 0 days.

(21) Appl. No.: 10/611,512

(22) Filed: Jul. 1, 2003

(65) Prior Publication Data

US 2005/0011347 A1 Jan. 20, 2005

(51) Int. Cl.
*F41H 1/02* (2006.01)
*F41H 5/04* (2006.01)

(52) U.S. Cl. ..... 89/36.02; 89/36.05; 2/2.5

(58) Field of Classification Search ..... 89/36.02, 89/36.05; 2/2.5; 428/911
See application file for complete search history.

(56) References Cited

U.S. PATENT DOCUMENTS

| | | | | | |
|---|---|---|---|---|---|
| 2,445,801 | A | * | 7/1948 | Partiot | 219/78.12 |
| 4,186,648 | A | * | 2/1980 | Clausen et al. | 89/36.02 |
| 4,292,882 | A | * | 10/1981 | Clausen | 89/36.02 |
| 4,507,353 | A | * | 3/1985 | Kuhlmann et al. | 428/222 |
| 4,786,541 | A | * | 11/1988 | Nishimura et al. | 428/102 |
| 4,969,386 | A | | 11/1990 | Sandstrom et al. | |
| 5,087,516 | A | | 2/1992 | Groves | |
| H1061 | H | | 6/1992 | Rozner et al. | |
| 5,200,256 | A | * | 4/1993 | Dunbar | 428/212 |
| 5,362,527 | A | * | 11/1994 | Harpell et al. | 428/33 |
| 5,364,679 | A | * | 11/1994 | Groves | 428/76 |
| 5,443,917 | A | | 8/1995 | Tarry | |
| 5,511,241 | A | * | 4/1996 | Ziegler | 2/2.5 |
| 5,736,474 | A | | 4/1998 | Thomas | 442/393 |
| 5,738,925 | A | * | 4/1998 | Chaput | 428/101 |
| 5,771,488 | A | * | 6/1998 | Honkala | 2/2.5 |
| 5,824,940 | A | * | 10/1998 | Chediak et al. | 89/36.05 |
| 5,903,920 | A | * | 5/1999 | Granqvist | 2/2.5 |
| 6,035,438 | A | | 3/2000 | Neal et al. | |
| 6,370,690 | B1 | * | 4/2002 | Neal | 2/2.5 |
| 6,510,777 | B1 | | 1/2003 | Neal | |
| 6,589,891 | B1 | * | 7/2003 | Rast | 442/1 |
| 6,846,545 | B1 | | 1/2005 | Thomas | 428/89 |
| 2002/0073473 | A1 | * | 6/2002 | Bachner et al. | 2/2.5 |

OTHER PUBLICATIONS

Webster's New World Dictionary; p. 519; Copyright 1966.*
Webster's Ninth New Collegiate Dictionary; p. 443; Copyright 1958.*
Webster's Encyclopedic Unabridged Dictionary; p. 2200; Copyright 1996.*

* cited by examiner

*Primary Examiner*—Stephen M. Johnson
(74) *Attorney, Agent, or Firm*—Andrew Wilford

(57) ABSTRACT

An armor, especially a body armor has at least one layer and preferably a multiplicity of layers of a woven ballistic fabric with titanium beads or disks threaded onto the yarns at the crossovers to serve as a projectile shredders. The titanium beaded fabric layers may be used in conjunction with other ballistic fabrics and armor designed to catch and trap resultant projectile fragments in a body armor or other type of shield or armor.

16 Claims, 3 Drawing Sheets

BODY ARMOR

FIELD OF THE INVENTION

My present invention relates to an improved armor, especially a body armor and, more particularly, to a lightweight body armor having improved ability to withstand penetration by high velocity rounds.

BACKGROUND OF THE INVENTION

Body armor and armor for other purposes which are intended to provide a barrier to high velocity rounds generally comprise, in a vest or other structure, a rigid plate, either of ceramic, steel or high tensile strength fibers such as aramid, polyethylene or poly-p-phenylene benzo-bis-oxazole fiber laminated into a rigid plate using a thermoset or other boding resin.

Body armor and armor for other purposes which are intended to provide a flexible barrier to high velocity rounds generally comprise, in a vest or other structure, a ballistic fabric which can contain ceramic disks or particles, hereinafter referred to as beads, which create a barrier to the passage of a round.

A typical ceramic bullet proof fabric is found in the CHEDIAK et al U.S. Pat. No. 5,824,940 which comprises a plurality of layers of fabric and ceramic structures which are fastened to fabric.

Other armors utilizing similar principles are disclosed in:

| | |
|---|---|
| CLAUSEN et al | U.S. Pat. No. 4,186,648 |
| SANDSTROM | U.S. Pat. No. 4,969,386 |
| DUNBAR | U.S. Pat. No. 5,200,256 |
| GROVES | U.S. Pat. No. 5,364,679 |
| TARRY | U.S. Pat. No. 5,443,917 |
| NEAL et al | U.S. Pat. No. 6,035,438 |
| NEAL | U.S. Pat. No. 6,510,777 |
| GROVES | U.S. Pat. No. 5,110,661 |
| GROVES | U.S. Pat. No. 5,087,516 |
| ROZNER et al | U.S. Statutory Invention Reg. No. H1O61 |

All of these systems have various drawbacks, some of which will be discussed in greater detail hereinafter. One of the principal drawbacks, however, of armors which utilize ceramic or glass beads or beads of similar material is that the ceramic tends to break up upon impact and thus, in the process of slowing down a high velocity round, itself loses integrity and the ability to continue to participate in the velocity attenuation process.

Other principal drawbacks of ceramic armor, or any rigid plate armor are inflexibility (stiffness) and weight.

The prior art armors to a significant extent attempt to introduce layers which are designed to slow down and eventually trap the round by providing surfaces in front of the round as it passes through the armor.

OBJECTS OF THE INVENTION

It is, therefore, the principal object of the present invention to provide an improved armor which is of light weight and high flexibility and which does not suffer from deterioration during use in the same sense as the disintegrating ceramic armors hitherto provided.

Another object of this invention is to provide an improved body armor which is free from drawbacks of earlier systems.

It is also an object to provide an improved armor which can be used for a variety of purposes depending upon the number of layers used.

SUMMARY OF THE INVENTION

These objects and others which will become apparent hereinafter are attained, in accordance with this invention in an armor which comprises:

at least one projectile destroying layer having a woven ballistic fabric with yarn cross overs and metallic disks, particularly titanium disks traversed by the yarns at the cross overs; and at least one layer containing ballistic fibers for trapping projectile fragments behind the projectile destroying layer.

I have discovered that, quite surprisingly, an armor can be made more effective not only by placing impact absorbing surfaces in front of a high velocity round entering the armor, but rather by designing at least one layer of the armor so that it acts primarily along the flanks of the bullet as it passes through the armor to deflect the bullet, to damage the flanks of the bullet to the point that fibers in the armor will more readily seize the bullet and by physically destroying the round because of the engagement of the titanium disks with the flanks thereof.

More particularly, I have found that when titanium disks are threaded onto the yarns at weft/warp cross overs of a ballistic fabric to make a beaded fabric, the disks tend to grip the sides of the bullet and actually damage those sides and actually deflect the bullet from a straight line path through the armor so that the number of fibers of the fabric and disks which engage the bullet increases significantly. The disks, moreover, being composed of titanium metal, are not brittle and therefore do not break up upon engagement with the bullet so that they retain their integrity and can readily seize the bullet from its sides and tear the projectile apart.

The invention thus resides in the shredding of the incoming round and the capture of its fragments, as opposed to the blunting of the projectile, and in the positioning of the beads or disks so that the edges thereof are presented to the projectile (by reason of threading of the disks on the yarns).

According to a feature of the invention the woven ballistic fabric is composed of high tensile strength fibers such as aramid, ultra-high molecular weight polyethylene or poly-p-phenylenebenzo-bis-oxazole, PBO which may be marketed under the fiber or fabric names of Spectra, GoldFlex, Kevlar, Twaron, Zylon, DYNEEMA and the like. The titanium disks may be any size which allows them to be readily anchored upon both the weft and warp yarns at the cross overs of the ballistic fabrics and disks of a diameter of 3/32 of an inch and with a thickness of 1/32 of an inch have been found to be especially effective. As a general matter, the disks may range in diameter from 0.1 to 0.5 inch, in thickness from 0.01 to 0.025 inch and can have a hole which is centered or off center with a diameter of 0.01 to 0.2 inch.

Any commercial titanium metal or titanium metal alloy, or other high tensile strength ductile metal or alloy may be used and the disks need not be circular but may have irregular or polygonal outer peripheries. The armor should have at least one layer of the ballistic fabric and titanium disks although multiple layers may be present and the layer or layers of ballistic fabric and titanium disks may be backed by one or more layers of ballistic fabric. The disks can have holes which are non-circular or a plurality of holes through which the warp and weft yarns can pass.

If desired, an adhesive can bond the disks to the yarns at the cross overs.

According to a feature of the invention, the titanium disk ballistic fabric in one or more layers and one or more backing ballistic fabric layers may be combined in an appropriate fabric shell, preferably also of a ballistic material to form the body armor.

I can use 2 to 25 beaded layers according to the 20 invention, preferably 5 to 20 and even more preferably 6 to 15 layers. The yarns which may be used on the fabric can be 20 denier to 1500 denier (dtex), preferably 50 to 100 denier. The titanium disk density per layer of beaded fabric was 10 to 500 per square inch, preferably 50 to 250 per square inch and more preferably 75 to 150 per square inch. The thread density may range from 5 to 100 threads to the inch for both warp and weft.

By varying the number of beaded layers within the beaded section and/or ballistic fabric layers within the ballistic fabric section and/or the combination of beaded layers and ballistic fabric layers and/or the types of commercially available ballistic fibers within the sections (common practice within the armor industry), various level of ballistic protections can be achieved. For example, by combining 3 layers of beaded fabric with 5 layers of ballistic fabric, protection from rounds as defined in the U.S. Department of Justice's specification for Police Body Armor NIJ 0101.04 Level I may be achieved. By combining 6 layers of beaded fabric with 15 layers of GoldFlex NIJ 0101.04 Level III protection can be achieved.

BRIEF DESCRIPTION OF THE DRAWING

The above and other objects, features, and advantages will become more readily apparent from the following description, reference being made to the accompanying drawing in which.

SPECIFIC DESCRIPTION

While I have described an armor utilizing the basic projectile-shredding fabric of the invention and have focused on use as a body armor, it will be understood that this basic material can also be used as vehicle armor, for shields and as armor resistant to projectiles of all types and at all levels of protection by assembling it with other layers of the same material or ballistic fabric or both and even utilizing the projectile-trapping and energy absorbing layers of the prior art.

Figure 1:
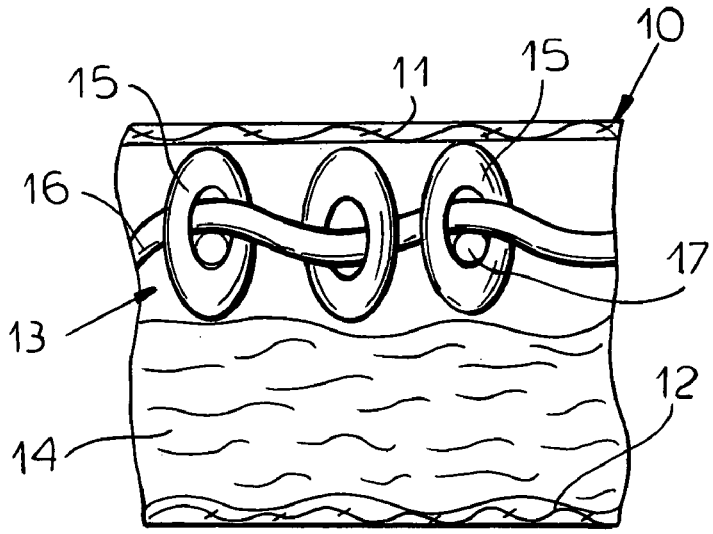
FIG. 1 is a cross section through an armor showing the layers thereof in diagrammatic form.

The basic construction of an armor according to the invention is shown in FIG. 1.

There the armor 10 comprises a casing material represented by the thin fabric layers 11 and 12 between which any number of titanium-bead projectile-shredding layers may be provided at 13 together with any number of ballistic fabric layers at 14 to catch and trap the particles of the projectile which has been shredded by the titanium beads.

The titanium beads, shown as disks 15 in FIG. 1 are anchored in the weft 16 and warp 17 of a ballistic fabric which can consist of a high tensile strength fiber such as aramid, polyethylene or PBO threads at the cross overs of them.

It will be understood that the ballistic fabric 14 can be composed of the same yarns or different yarns from the aramid, polyethylene, PBO high tensile strength fiber group and can be provided in any number of layers.

For example, two or more layers of the disk armor may be separated by ballistic fabric without disks, the ceramic-bead fabrics of the prior art or any combination thereof.

Figure 2:
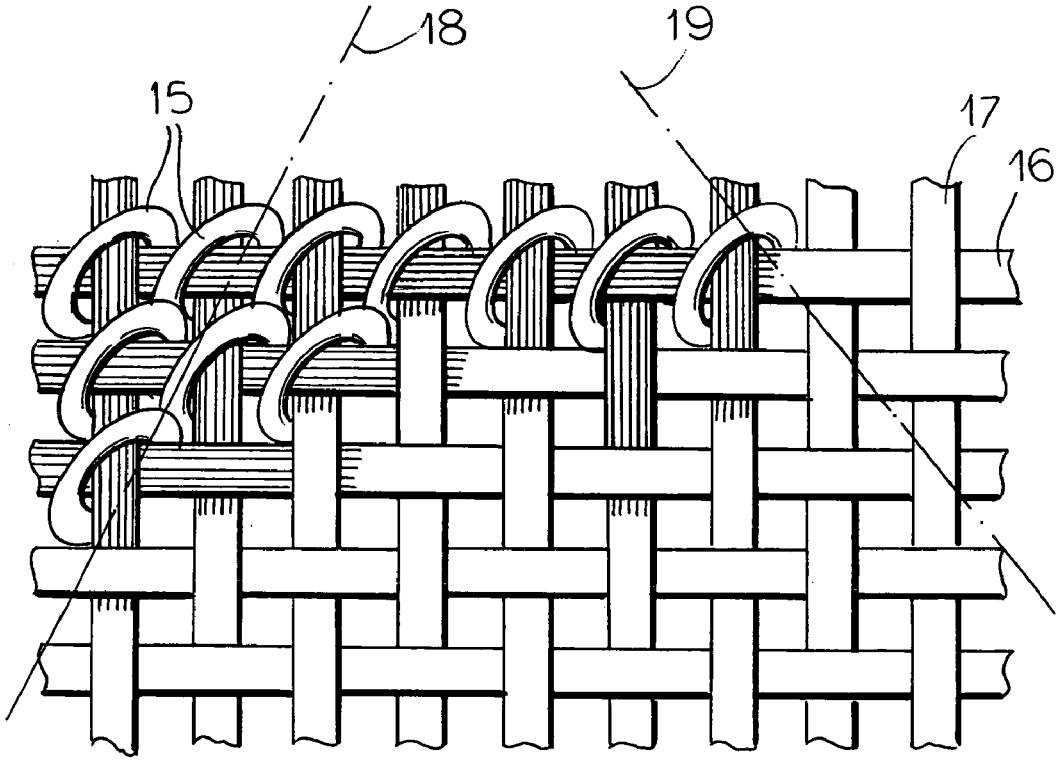
FIG. 2 is a plan view in highly diagrammatic form of an armor layer according to the invention.

In FIG. 2, I have shown the warp yarns 16 and the weft yarns 17 having circular titanium beads at their cross overs and all of the titanium disks oriented in the same direction and distributed regularly at the cross overs.

If desired, additional layers with the titanium disks oppositely oriented and staggered with respect to the layer of FIG. 2 may be assembled with it. In addition, diagonal yarns 18 and 19 which can pass through the titanium disks or around the titanium disks may be interwoven with the warp and weft.

Figure 3:
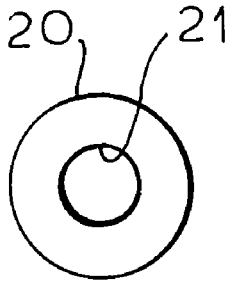
FIGS. 3–6 are four diagrams of titanium disks which can be used according to the invention.
Figure 4:
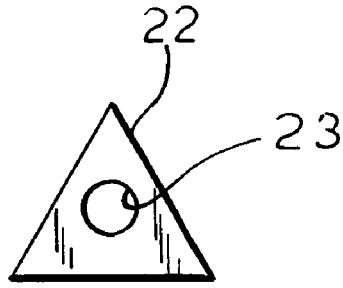
Figure 5:
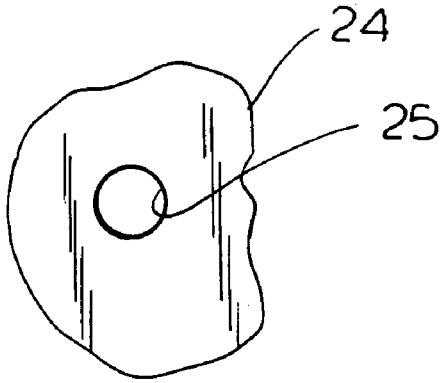
Figure 6:
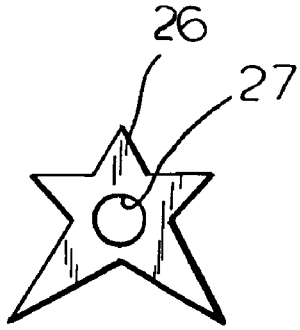

In general, the titanium beads will have diameters of 3/32 of an inch and thicknesses of 1/32 of an inch+15%. The titanium beads may have central holes or holes offset from the entire, regular peripheries or irregular peripheries or the configuration of regular or irregular polygons. For example, in FIG. 3 I have shown a circular titanium disk 20 with a circular hole 21 whereas in FIG. 4 the titanium bead is of triangular configuration at 22 with a circular hole 23. In FIG. 5 the periphery of the disk 24 is irregular and the hole 25 is circular whereas a star shaped disk is provided at 26 in FIG. 6 with a circular hole 27. The points of the star can be uniform or, as shown in FIG. 6, can be irregular.

Figure 7:
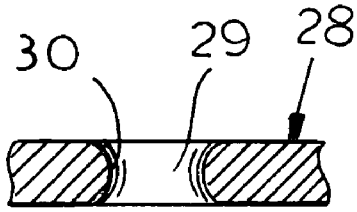
FIG. 7 is a cross sectional view through the hole in the center of the titanium bead.

In FIG. 7, I have shown a disk 28 with a hole 29 whose edges are rounded at 30 so that the disk will pose less of a danger of cutting the yarn.

Figure 8:
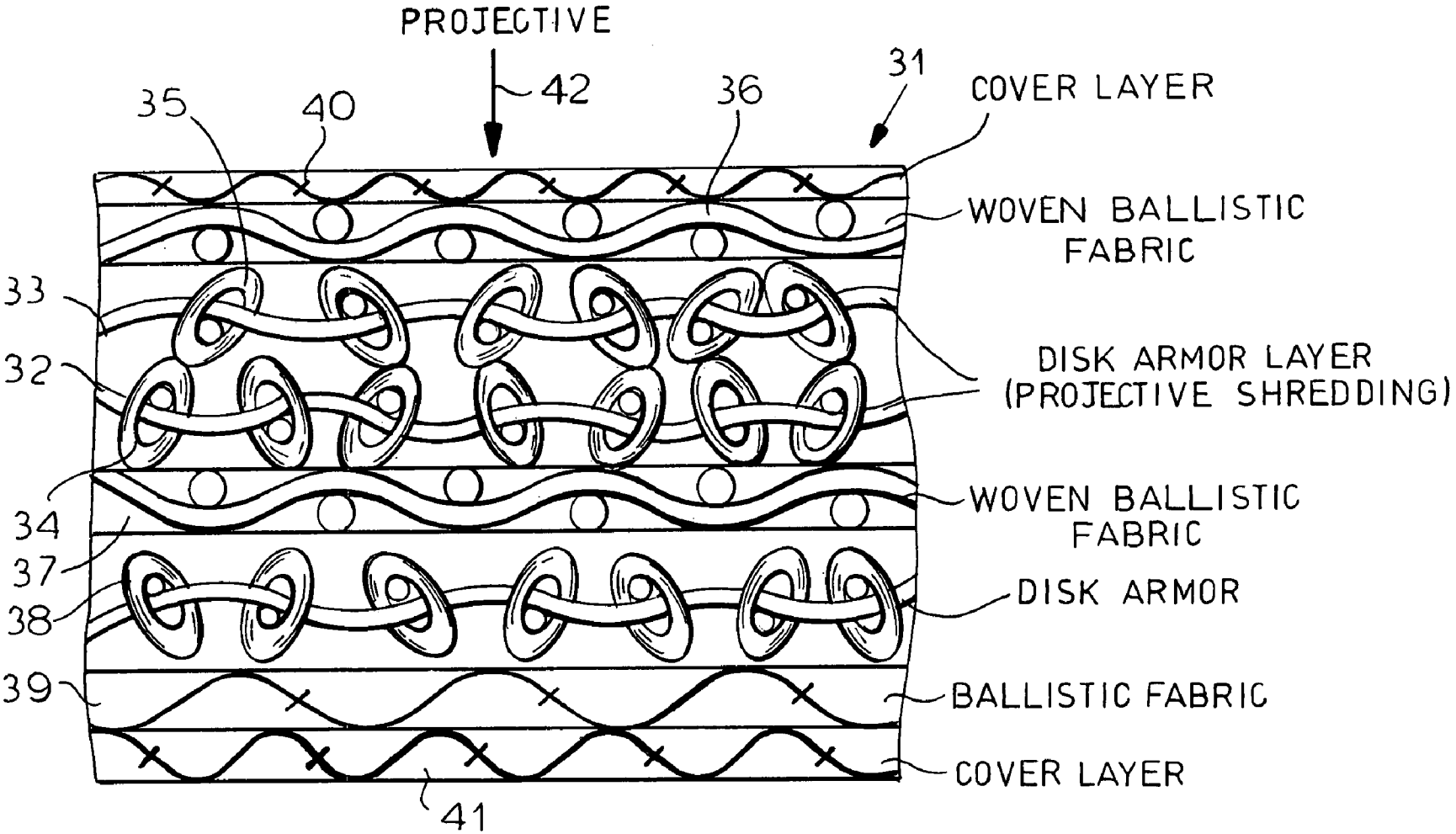
FIG. 8 is a diagram of a composite armor comprising multilayers of the projectile layer shredding layer of this invention and ballistic fabric and appropriate casing layers.

In FIG. 8, I have shown an armor 31 which is assembled from a multiplicity of the disk armor layers 32, 33 previously described in which the disks 34, 35 in each layer are oriented in different directions and are staggered from layer to layer. A ballistic fabric can be provided between these layers. However, at least one woven ballistic fabric 36 is provided as an anti-ricochet layer to trap particles of the projectile torn away by the disks. A further layer 37 of the ballistic fabric may also serve for that purpose and it has been found to be advantageous to provide at least one further titanium disk shredding layer at 38 rearwardly of at least one ballistic layer 37 and a further woven ballistic fiber 39 layer rearwardly of the latter. The cover layers 40 and 41 can also be provided as has been described. The arrow 42 represents the direction in which the projectile is directed.

In use, the titanium disks of the disk armor layers serve to engage and shred the projectile as it penetrates the disk armor layer and the fabric of the disk armor layers and the additional woven ballistic fabric, trap the particles into which the projectile is shredded.

Depending upon the number of layers of various types, projectiles of all kinds can be trapped or stopped. For example, 155 layers can stop an antitank round while 32 layers of the disk armor and the woven ballistic fabric can stop all handgun rounds while only about 20 layers is necessary to stop low power handgun rounds.

SPECIFIC EXAMPLE

The construction of the shot pack was 6 layers of 18" by 18" "beaded" fabric which then had 15 layers of Honeywell s "GoldFlex" material placed 6" behind it. The GoldFlex was also encased by 1500 denier "ballistic" nylon fabric.

In armoring terms, therefore, the shot-pack was 6 layers of titanium beaded fabric, 1 layer of 1500 denier ballistic nylon, 15 layers of GoldFlex, 1 layer of 1500 denier ballistic nylon.

The six layers beaded fabric had 0.125"dia×0.034" thick titanium disks with a 0.050" dia hole in the center woven as beads with 180 denier aramid yarn in both warp and fill directions. Each square inch of the material had approximately 100 disks (10 by 10). Overall, the thickness of the 6 layers was approximately 0.400".

Both the ballistic nylon and GoldFlex fabrics were commercially available. Overall thickness of the GoldFlex was approximately 0.300". The nylon added another 0.100". The GoldFlex and nylon combined had an "areal density" of 0.96 pounds per square foot (psf).

Total weight for the shotpack (beaded fabric GoldFlex and nylon combined) was 5.1 pounds, giving an areal density of 2.7 psf.

The shotpack was then suspended from a wooden frame at a distance of 16 feet from the muzzle of a 0.308 caliber rifle on an outdoor rifle range on an average early summer day (around 70 deg F./70% relative humidity). A 0.020" thick 6061-T6 aluminum "witness" plate was then set 6" behind the GoldFlex/nylon section. The rifle was set on sandbags on top of a concrete stand. A commercially available American Eagle 0.308 Winchester 150 grain FMJ Boat Tail round with a stated (but unmeasured) muzzle velocity of 2820 fps was then shot at the armor and fully captured by the 12th layer of the GoldFlex portion of the pack. There was no deformation or penetration of the aluminum plate.

This methodology of testing approximates that described in the U.S. Department of Justice's specification for Armor Materials, NIJ 0108.01, Level III protection except the velocities of the rounds were not measured by chronograph. Also, NIJ 0108.01 testing is identical to NIJ 0101.04 except for the lack of blunt trauma measure using ballistic clay. However, since there was no impact to the aluminum witness plate in the NIJ 0108.01-style test, the blunt trauma protection of NIJ 0101.04 Level III should be able to be achieved.

While I prefer to use titanium beads or disks as noted, other high-strength materials may be used instead or in addition as beads or disks. In particular I may use a Vascomax alloy/compound such as Vascomax C-300 (0.1% Al, 0.02% C, 8.8% C, 0.05% Mn, 4.8% Mo, 18.5% Ni, 0.005% P, 0.005% S, 0.05% Si and 0.73% Ti, bal Fe), an inconel alloy (NiCrFe), steel or hardcoat anodized aluminum (e.g. hardcoat 6061-T6 AL).

The fabric can, in addition to the filaments and fibers named, use any fiber or wire of sufficient tensile strength, including metallic filaments and esoteric filaments such as those made from spider silk or the like.

Furthermore, while threading the disks onto the yarn will automatically present the edges of the disks or beads to the projectile, the beads may be held in place alternatively or in addition by gluing or tying them to the fabric.

I claim:

1. An armor comprising:

at least one projectile-destroying layer having a woven ballistic fabric with yarn crossovers between weft and warp yarns and metal disks resistant to disintegration upon impact with a projectile and through each of which at least one of the weft and warp yarns is threaded at the respective crossover so that the disks are oriented transverse to the fabric with their edges presented to flanks of a projectile penetrating into the projectile-destroying layer so as to shred the projectile; and at least one layer containing ballistic fibers for trapping projectile fragments behind said projectile-destroying layer.

2. The armor defined in claim 1 wherein said woven ballistic fabric is composed of fibers selected from the group which consists of aramid, polyethylene and poly-p-phenylenebenzo-bis oxazole yarns.

3. The armor defined in claim 2 wherein said yarns have a denier between 19 and 1500 dtex.

4. The armor defined in claim 3 wherein said ballistic fabric has a yarn density of 5 threads per inch to 100 threads per inch.

5. The armor defined in claim 1 wherein there are a plurality of said projectile-destroying layers and a plurality of said layers for trapping projectile fragments in a ballistic fabric shell forming a body armor.

6. The armor defined in claim 1 wherein said disks are composed of titanium, titanium alloy, or other ductile metal or alloy capable of shredding a projectile penetrating into the projectile-destroying layer.

7. The armor defined in claim 6 wherein said disks are circular.

8. The armor defined in claim 6 wherein said disks have irregular or polygonal contours.

9. The armor defined in claim 1 wherein said ballistic fiber is selected from the group which consists of aramid, polyethylene or poly-p-phenylenebenzo-bis oxazole fiber.

10. A projectile-destroying layer for use in an armor and comprised of a woven ballistic fabric with yarn crossovers between warp and weft yarns of aramid, polyethylene or poly-p-phenylenebenzo-bis-oxazole fiber and metal disks resistant to disintegration upon impact with a projectile and anchored at at least some of said crossovers and consisting of a metal capable of tearing apart a projectile entering said layer, and selected from the group of titanium and titanium alloys, said disks each being traversed by at least one of the warp and weft yarns at at the respective crossovers so that the disks are oriented with their edges transverse to the fabric and presented to flanks of a projectile penetrating into the projectile-destroying layer so as to shred the projectile.

11. The projectile-destroying layer defined in claim 10 wherein said fabric is composed of at least one yarn spun from a material resistant to disintegration upon impact with a projectile and selected from the group which consists of aramid, polyethylene or poly-p-phenylene benzo-bis-oxazole fiber.

12. A projectile-destroying structure for an armor consisting of a plurality of layers as defined in claim 10.

13. The structure defined in claim 12 which comprises 2 to 155 of said projectile-destroying layers.

14. A projectile-destroying layer for use in an armor and comprised of a woven ballistic fabric with yarn crossovers between warp and weft yarns of aramid, polyethylene or poly-p-phenylene benzo-bis-oxazole fiber and metal disks resistant to disintegration upon impact with a projectile and anchored at at least some of said crossovers and consisting of a metal capable of tearing apart a projectile entering said layer, and selected from the group of titanium and titanium alloys, said disks each being traversed by at least one of the warp and weft yarns at the respective crossovers so that edges of the disks are presented to flanks of a projectile penetrating into the projectile-destroying layer so as to shred the projectile, said disks being provided in a density of 10 to 500 per square inch.

15. The projectile-destroying layer defined in claim 14 wherein said fabric has a thread density for the warp and weft of 5 to 100 threads per inch.

16. The projectile-destroying layer defined in claim 15 wherein said yarn has a diameter of 10 to 1500 dtex.

* * * * *